US011091229B2

(12) United States Patent
Beaudet et al.

(10) Patent No.: US 11,091,229 B2
(45) Date of Patent: Aug. 17, 2021

(54) SHIP PROVIDED WITH AN INSTALLATION FOR LAUNCHING AND RECOVERING VEHICLES

(71) Applicant: CHANTIERS DE L'ATLANTIQUE, Saint Nazaire (FR)

(72) Inventors: Etienne Beaudet, Saint Nazaire (FR); Adrien Benoist, Saint Nazaire (FR)

(73) Assignee: Chantiers De L'Atlantique, Saint Nazaire (FR)

( * ) Notice: Subject to any disclaimer, the term of this patent is extended or adjusted under 35 U.S.C. 154(b) by 112 days.

(21) Appl. No.: 16/341,009

(22) PCT Filed: Oct. 9, 2017

(86) PCT No.: PCT/EP2017/075662
§ 371 (c)(1),
(2) Date: Apr. 10, 2019

(87) PCT Pub. No.: WO2018/069241
PCT Pub. Date: Apr. 19, 2018

(65) Prior Publication Data

US 2020/0180734 A1 Jun. 11, 2020

(30) Foreign Application Priority Data

Oct. 11, 2016 (FR) ..... 1659785

(51) Int. Cl.
*B63B 27/16* (2006.01)
*B63B 23/26* (2006.01)

(52) U.S. Cl.
CPC ..... *B63B 23/26* (2013.01)

(58) Field of Classification Search
CPC ... B63B 27/16; B63B 2027/165; B63B 23/30; B63B 23/34; B63B 23/26; B63B 27/36
See application file for complete search history.

(56) References Cited

U.S. PATENT DOCUMENTS

| | | | | |
|---|---|---|---|---|
| 3,536,023 | A * | 10/1970 | Bascom | B63B 27/36 114/259 |
| 4,245,578 | A | 1/1981 | Bianco et al. | |
| 5,941,192 | A | 8/1999 | Tavone et al. | |
| 9,611,012 | B2 * | 4/2017 | Lin | B63B 27/16 |
| 2009/0199757 | A1 * | 8/2009 | Roodenburg | B63B 23/34 114/268 |
| 2018/0312225 | A1 * | 11/2018 | Peleg | B63B 21/64 |

FOREIGN PATENT DOCUMENTS

| | | | |
|---|---|---|---|
| GB | 2150903 | A | 7/1985 |
| GB | 2277718 | A | 11/1994 |
| WO | WO-2015/087074 | A1 | 6/2015 |

* cited by examiner

*Primary Examiner* — Andrew Polay
(74) *Attorney, Agent, or Firm* — Harness, Dickey & Pierce, PLC

(57) ABSTRACT

The present disclosure concerns a ship provided with an installation for launching and recovering floating or submersible vehicles, that includes a lifting device having a set of cables that holds a basket configured to support the vehicle during launching and recovering operations, the cables being movable vertically between two positions, a high and a low position respectively. The basket includes an upper face that bears against a surface, referred to as a "contact surface", of the lifting device, only when the cables are in the high position.

19 Claims, 11 Drawing Sheets

SHIP PROVIDED WITH AN INSTALLATION FOR LAUNCHING AND RECOVERING VEHICLES

CROSS-REFERENCE TO RELATED APPLICATIONS

This application is a National Phase Entry of International Patent Application No. PCT/EP2017/075662, filed on Oct. 9, 2017, which claims priority to French Patent Application Serial No. 1659785, filed on Oct. 11, 2016, both of which are incorporated by reference herein.

TECHNICAL FIELD

The present invention relates to a ship provided with an installation for launching and recovering floating or submersible vehicles, which comprises a lifting device including a set of cables which retains a basket configured to support said vehicle during said launching and recovering operations.

BACKGROUND

Ships provided with an installation for launching and recovering floating or submersible vehicles are already known. Thus, there exist fixed or movable ramps allowing crafts to be beached on the rear portion of a ship. But these ramps must have a particular shape to be associated with the hull shape of the crafts. Under these conditions, this specific shape interferes with their versatility. Moreover, shocks caused by beaching represent a risk for persons and/or the crafts.

Also known is the floodable dock system, which is a compartment provided in the interior of a ship which can be opened to the outside and submerged. Under certain environmental conditions, amplification phenomena of water movements are observed in the interior of the floodable dock which represent a risk during transfers. Moreover, floodable dock launching maneuvers using ballasting are long and tedious operations.

Davits, for their part, are systems which allow raising a craft by attaching one or more hooks to it, then moving it from the exterior to the interior of the ship. But these davits necessitate that the craft be especially equipped with lifting points. Moreover, these operations to be performed by the crew of the craft (recovery of the hook or the arm) are risky operations. And they are not compatible with craft of the drone type.

Cranes and gantries of the so-called "A Frame" type are versatile lifting means which can also be used in this context. But they have the same types of features and of limits as the davits mentioned above, the only difference being that they also allow submerged vehicles to be recovered (small exploration submersible, for example).

Described in document FR-A-2401867 is a handling device for a submersible vehicle, in this case a diving bell. The handling device comprises a single cable connected to a lifting "slider", which is guided along ramps. The top of the bell cooperates, via a central male member, with a centering device positioned over the chassis of the slider. Shock-absorbing pads are associated with this system. It is easily noted that the manipulation of such a device is not easy and that the presence of a cable in the central position interferes with the stability of the set, in the event that the guidance of the slider along the ramps is incorrectly engaged.

Documents U.S. Pat. No. 3,536,023, GB2150903 and WO 2015/087074 illustrate other types of handling devices. The result of the foregoing is that there exists an un-resolved need to have available a ship provided with a launching and recovering system for floating or submersible vehicles which is as versatile and safe as possible, so that it is compatible with a large variety of sizes and types of devices to be recovered, whether they are automatic (drones) or not.

Moreover, the invention seeks to ensure that the maneuver of the vehicle occurs under the best conditions, to preserve the equipment and also the integrity of persons who may participate in the maneuver.

SUMMARY

The present invention thus applies to a ship provided with an installation for launching and recovering floating or submersible vehicles, which comprises a lifting device including a set of cables which retains a basket configured to support said vehicle during said launching and recovering operations, said cables being movable vertically between two extreme positions, respectively high and low, characterized by the fact that said basket includes at least one upper face which bears against at least one surface, referred to as a "contact surface", of said lifting device, only when said cables are in the high position. Thus, due to the fact that said at least one upper face of the basket bears directly against a surface of the lifting device, the seesaw movements which would normally occur here are limited, so that the safety of persons who participate in the maneuver is greatly improved.

According to other advantageous features of this ship:

- said lifting device includes a dolly on which is arranged the set of cables, this dolly being configured to be moved horizontally;
- said "contact surface" of said lifting device consists of at least one portion of a lower face of said dolly;
- said "contact surface" of said lifting device consists of the lower face of stabilizing devices of said cables which protrude downward from said dolly;
- said basket is provided with at least one float;
- said "contact surface" of said lifting device consists of the lower face of stabilizing devices of said cables which protrude downward from said and said float includes at least one upper face which bears against said lower face of said stabilizing devices only when said cables are in the high position.

In conformity with a particular embodiment of the invention, the ship includes a guidance member which connects said basket to a wall of said ship, which is configured to block the possible translation movements of the "sway" and "surge" type and rotation movements of the "yaw" type of said basket, when this basket is in the flotation position. According to the advantageous features of this embodiment:

- said guidance member cooperates with at least one profile with a guidance path with a generally vertical direction mounted on said wall of said ship, said member including at least one end which is configured to be engaged in said at least one profile and to move in the vertical direction along said guidance path during said launching and recovering operations;
- said guidance member is coupled to two elements which are in contact with said wall of said ship, on either side of said guidance member, thus forming a linear rectilinear connection with the wall of said ship;
- said end of said guidance member has the shape of a sphere;

said guidance member cooperates with a pair of profiles with a guidance path with a generally vertical direction, mounted on said wall of said ship, this member including elements configured to each be engaged in a profile and to move in the vertical direction along said guidance path during said launching and recovering operations;

said dolly carries a pair of profiles which are configured to be selectively positioned above and in the extension of said profiles mounted on said wall.

BRIEF DESCRIPTION OF THE DRAWINGS

Other features and advantages of the invention will appear upon reading the following description of embodiments that are preferred, but not limiting of the invention. This description is made with reference to the appended drawings in which.

DETAILED DESCRIPTION

Figure 1:
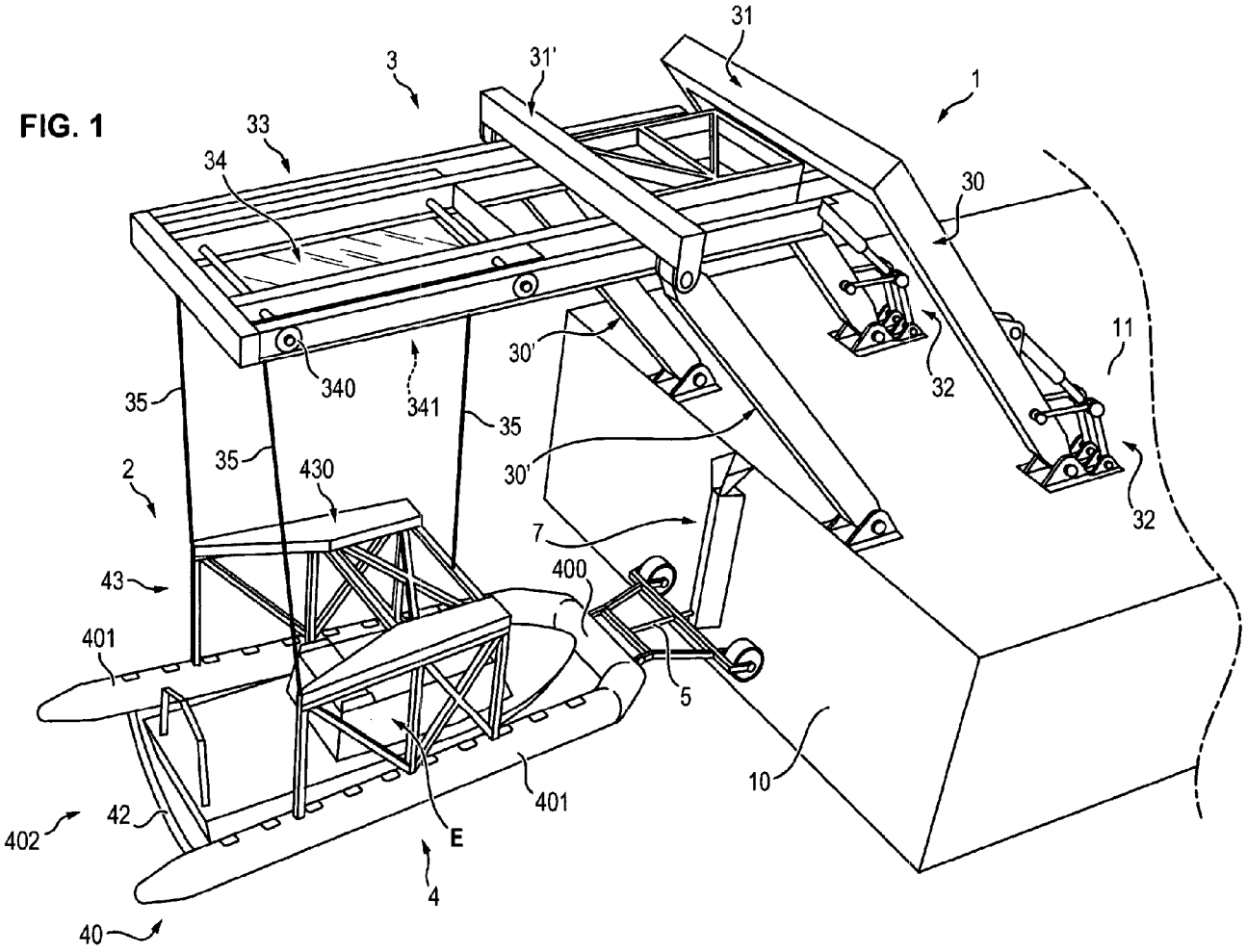
FIG. 1 is a perspective view of an installation which forms a portion of the ship according to the present invention, this ship being shown only very partially.

In all the appended figures, the ship 1 in question is only very partially shown, for reasons of simplification. In this particular case, it has been satisfactory to show a wall 10 of this ship, a generally vertical wall which can consist for example of a portion of the hull of the ship. Also shown is a flat surface 11 which preferably consists of an upper deck 11 of said ship.

This ship 1 is provided with an installation 2 for launching and recovering in a floating or submersible vehicle. More particularly, this installation 2 comprises a lifting device 3 which is installed on the aforementioned deck 11. This lifting device 3 could consist of a simple lifting crane or a gantry. However, in the exemplary embodiment which is shown here, the lifting device 3 is slightly different from a crane and its description is given hereafter.

Figure 5:
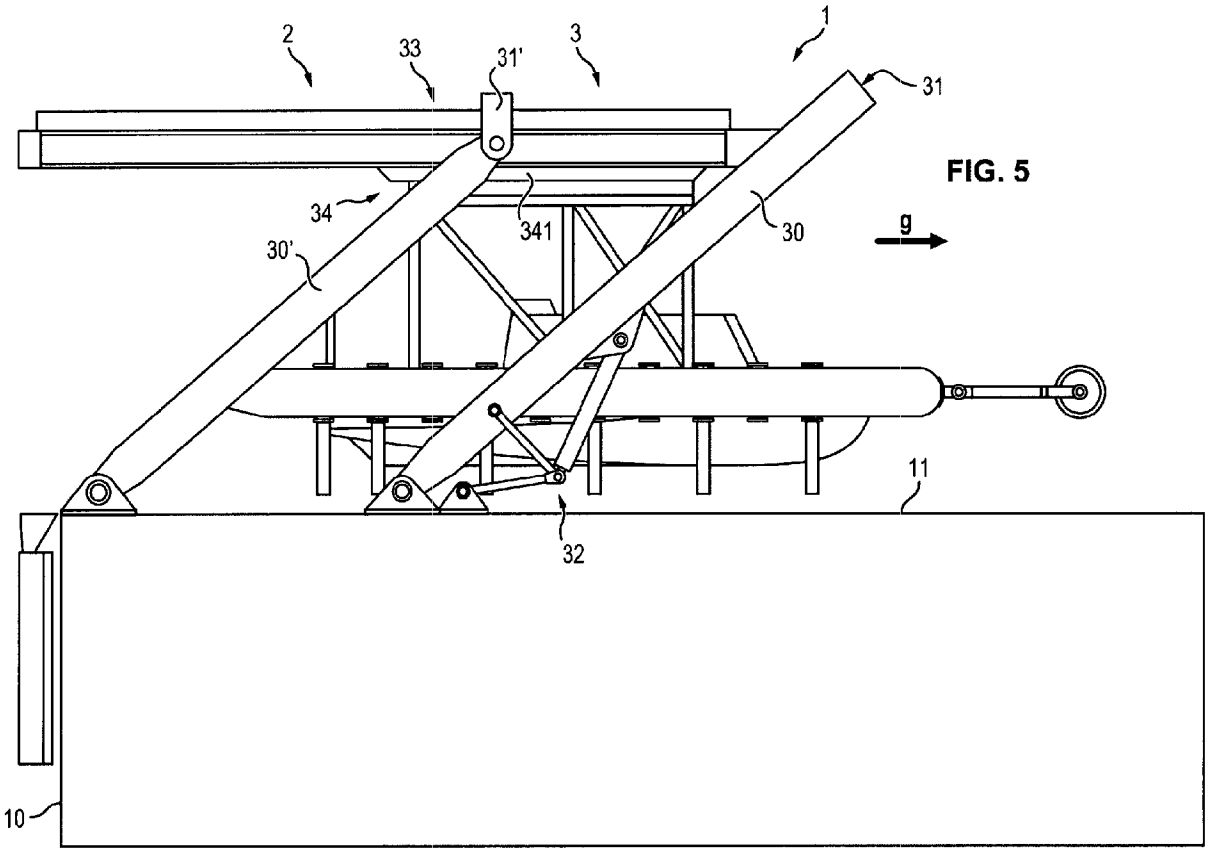
FIG. 5 is a view of the same installation, the craft being in a final position in which it can be deposited on the ship.
Figure 6:
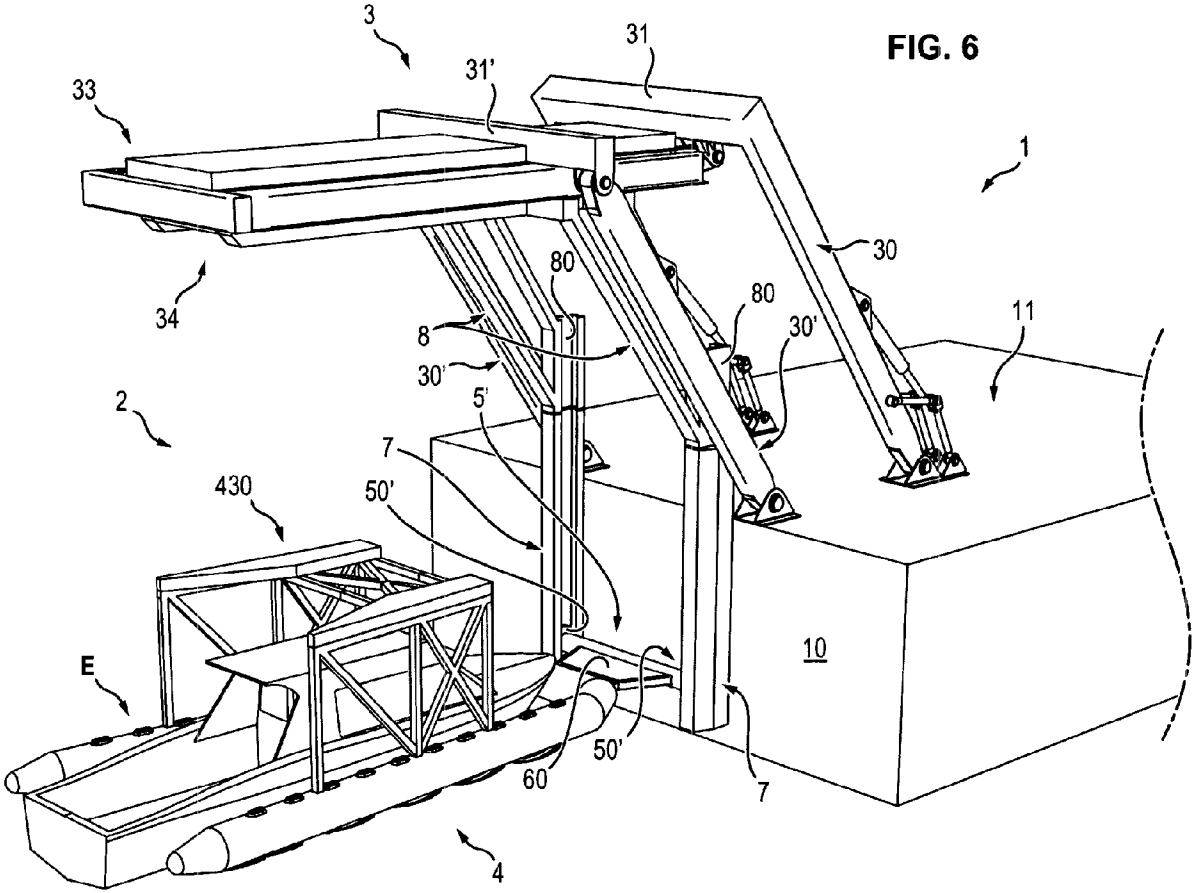
FIGS. 6 and 7 are perspective views, in two different directions, of a second embodiment of the invention, the cables of the installation not being shown and the craft being in a low position.
Figure 7:
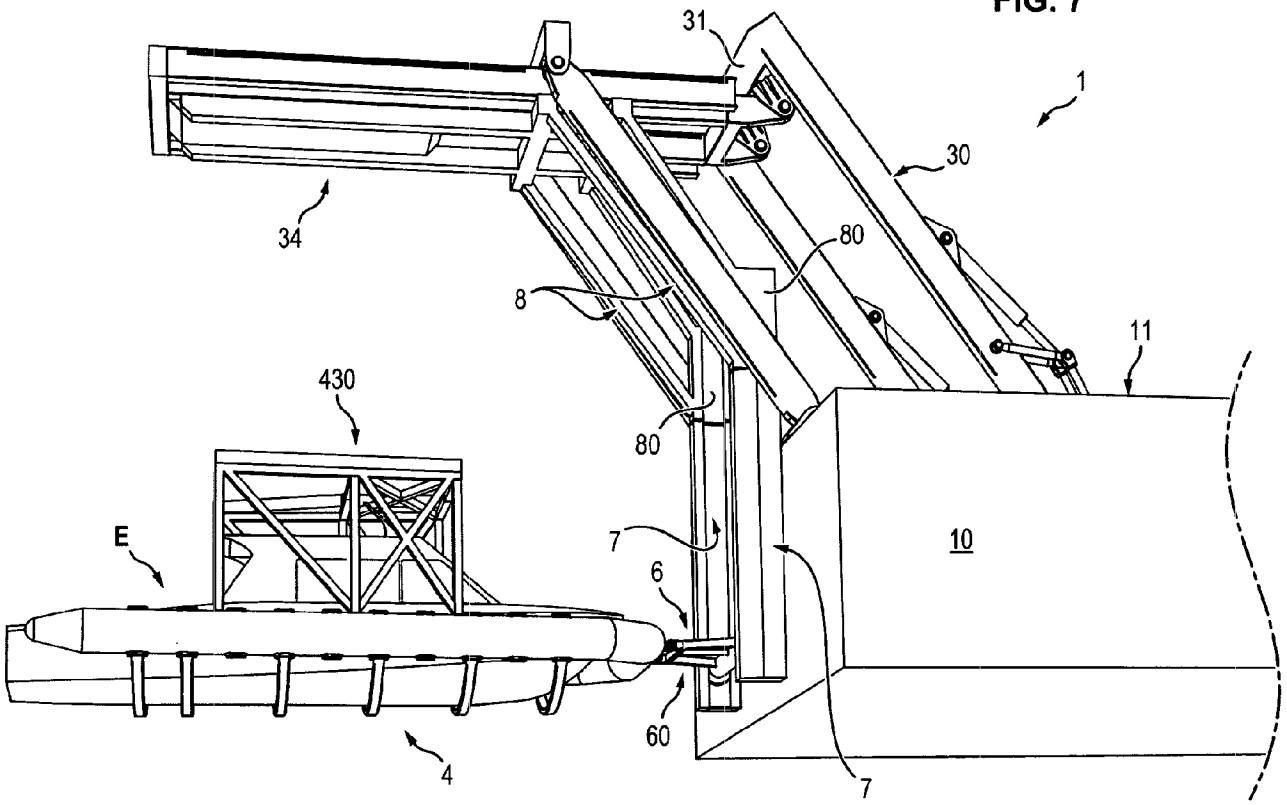
Figure 8:
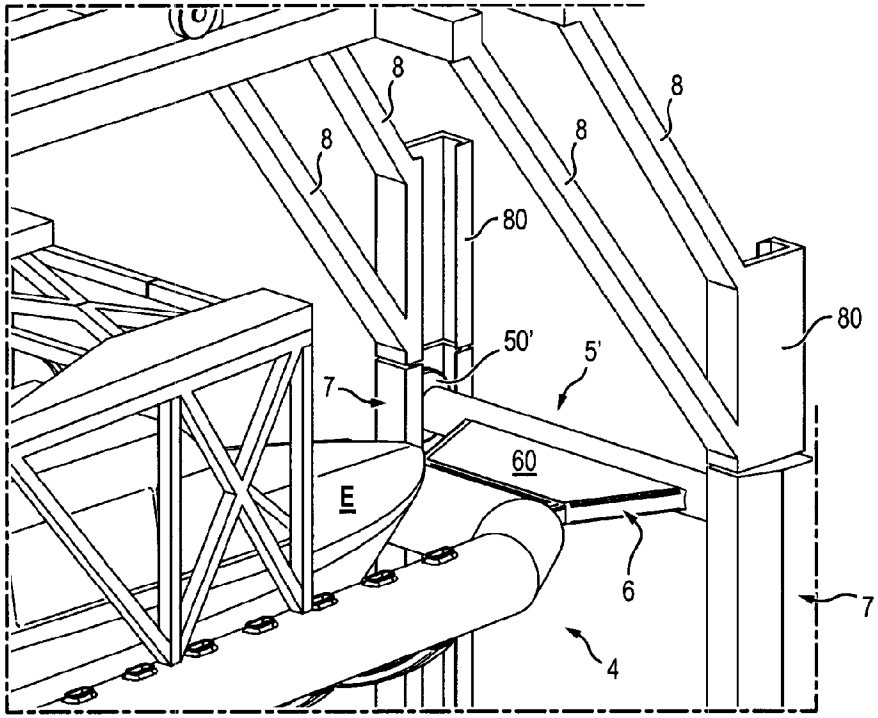
FIG. 8 is a perspective view particularly intended to show the structure of the guidance means used.
Figure 9:
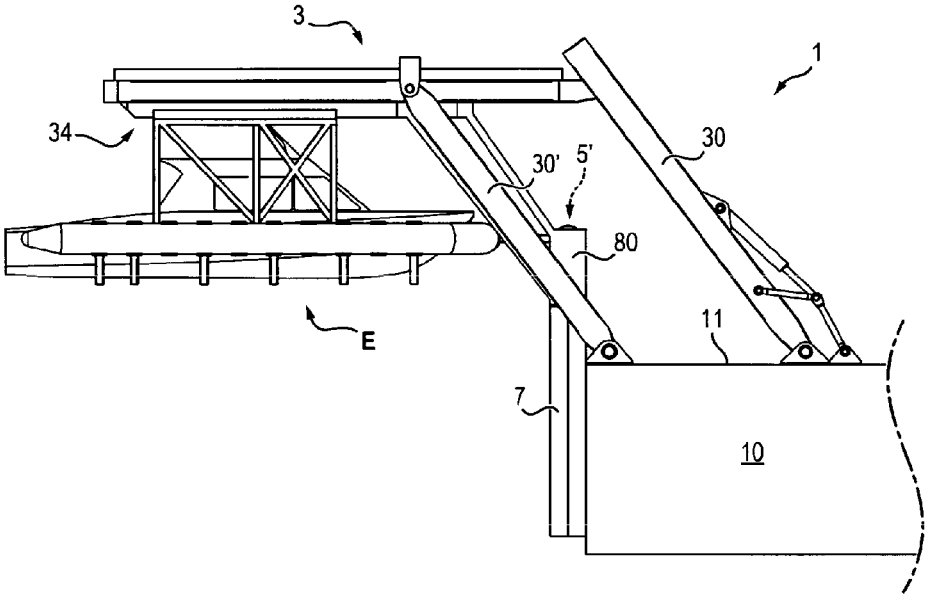
FIG. 9 is a side view of the installation of FIGS. 6 and 7, in a position substantially identical to that of FIG. 4.
Figure 10:
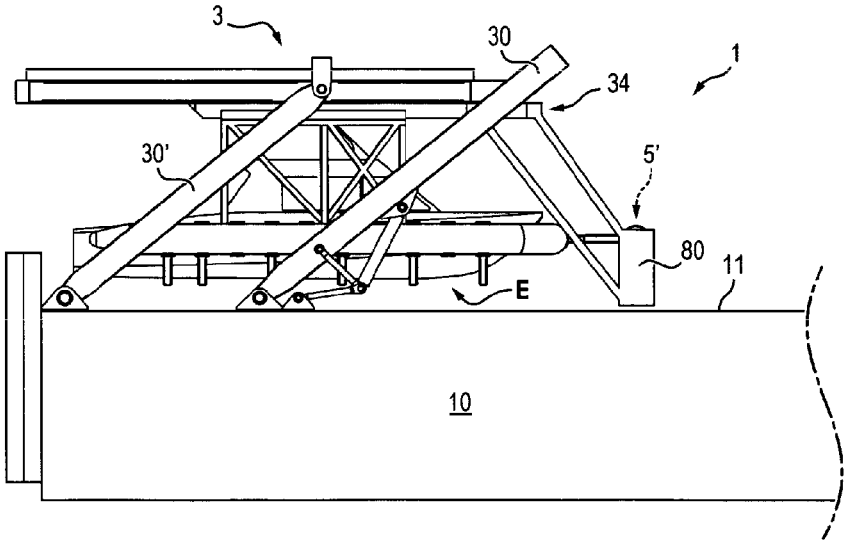
FIG. 10 is also a side view of the installation of FIGS. 6 and 7, in a position substantially identical to that of FIG. 5.

This lifting device comprises four legs 30 and 30' which are hinged to the deck 11 and which form together a fictitious and deformable rectangular parallelepiped. As shown more particularly by FIGS. 1 and 2, two legs 30 constitute one pair and are connected by a cross-member 31 so that the assembly constitutes a sort of inverted "U". This pair of legs 30 is the farthest from the edge of the deck 11. The second pair of legs 30', which is closest to the edge of the deck, includes a cross-member which is hinged to the pair of legs 30'. This cross-member is labeled 31'. The means which allow the legs 30 to be jointly actuated so as to impart to them a rotation movement so that they can pass from a position tilted toward the front to a position tilted toward the rear, as FIGS. 1 and 5, respectively, most particularly show, are labeled 32.

The lifting device 3 also comprises a parallelepiped plate 33 which is disposed as a cantilever, horizontally, in the vicinity of the apex of the pair of legs 30 and 30'. More particularly, one end of this plate is hinged with respect to the cross-member 31 and only guided with respect to the cross-member 31'. This plate is mostly cantilevered with respect to the pair of legs 30 and 30' so that, in the position of FIG. 1 as well as in that of FIG. 4, a large portion of this plate 33 is located vertically above the water over which the ship is positioned.

The plate 33 is provided with a movable dolly 34. To this end, the dolly 34 is provided with wheels 340 which can move along the guidance paths which are included in the opposite edges of the plate 33, as shown most particularly by FIGS. 1 and 2. The dolly 34 is provided with a lower face 341 of which the specific function will be explained later. This lower face has a horizontal rectangular surface with relatively large dimensions.

The dolly 34 is equipped with a set of cables 35 which, in the position of FIG. 1, are mostly unwound. Although this is not visible, the dolly 34 integrates a device for unwinding these cables so that these can be moved vertically, in the direction of the double arrow f of FIG. 2. In other words, these cables can be unwound so as to have a craft, which will be described later, occupy a low position as shown by FIGS. 1 and 2 and, respectively, a high position in which the cables are completely accommodated in the interior of the dolly 34, as shown more particularly in FIG. 4.

The set of cables 35 retains a basket 4 which is configured to support a vehicle consisting here, in the embodiment shown, of a craft E of the boat type. But it could be any other type of vehicle, for example a mini-submersible. This basket 4 includes a semi-rigid float 40 which has the shape, seen from above, of a "U" with a base 400 and two parallel flanks 401. This "U" shaped structure provides an access opening 402 for the craft E, an opening which is therefore located opposite the base 400 of the float 40.

Cables, chains, straps, a net or any other device 42 the function of which is to support the craft E extend between the flanks 401 of this float. Said float 40 has as its function to place the basket at a height compatible with the craft to be recovered and to allow said basket, when it is in the flotation position, to follow the movements of the water.

Figure 2:
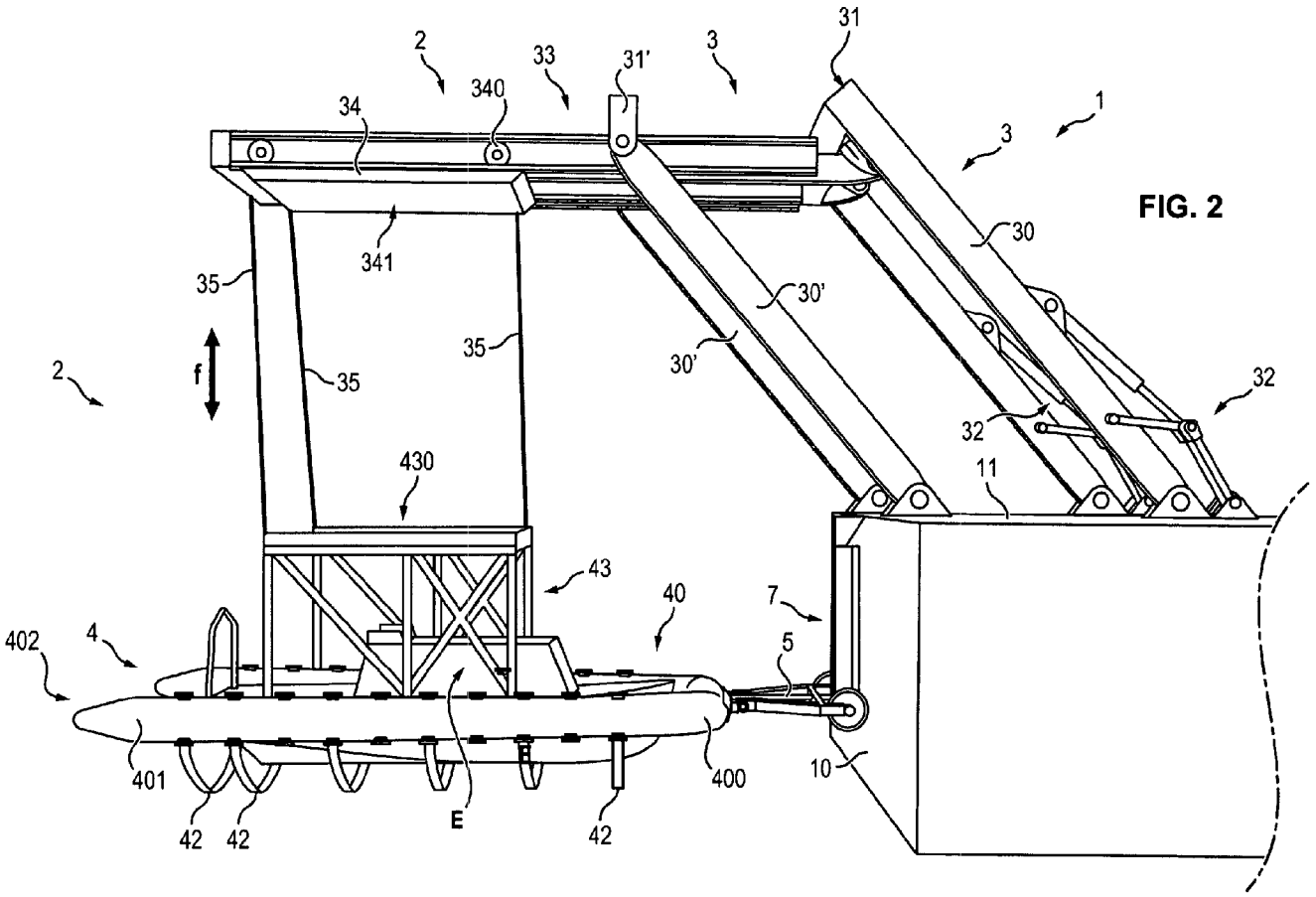
FIG. 2 is a side view of the installation of FIG. 1, the cables of this installation being shown on these two figures in the low position.

This support structure is capped by a slatted cage 43, of parallelepiped shape, which does not interfere in any way with the positioning of the craft in the basket 4 but can cover it at least partially, as shown more particularly in FIGS. 1 and 2. This cage 43 is endowed with an upper face 430. In the case shown here, this face is flat, horizontal and discontinuous (in two parts). But it could be otherwise.

In the embodiment illustrated in the appended drawings, the installation also comprises a guidance member 5 which connects the basket 4 to a wall of the ship, in this case the wall 10, member 5 which is configured to block the "yaw" (horizontal rotation movement around the vertical axis), and "surge" (translation on the horizontal transverse axis) and "sway" (rotation on the longitudinal horizontal axis) movements of the basket 4 during at least a portion of the vertical movement of the cables 35 in the direction of the double arrow f, but also when the basket 4 is in the flotation position. More precisely, referring to the appended FIG. 3, this guidance member has the shape of a rod 5 which is integrated here with a pair of arms 6 constituting a frame 60.

More precisely, the rod 5 extends substantially parallel to the two flanks 401 of the float 40 of the basket 4 during the transition phase. This guidance member is therefore integral with the aforementioned frame 60 which is itself hinged to the float. A pair of wheels, of inflatable rings or of skids 601, of which the function will be explained below, extends at the end of the arms 6. The free end of the rod 5 has the shape of a sphere 50. The guidance member, in this case the rod 5, cooperates with a profile 7 with a guidance path with a generally vertical direction, a profile 7 which is mounted on a wall of the ship, in this case the wall 10, as shown in the figures.

Figure 3:
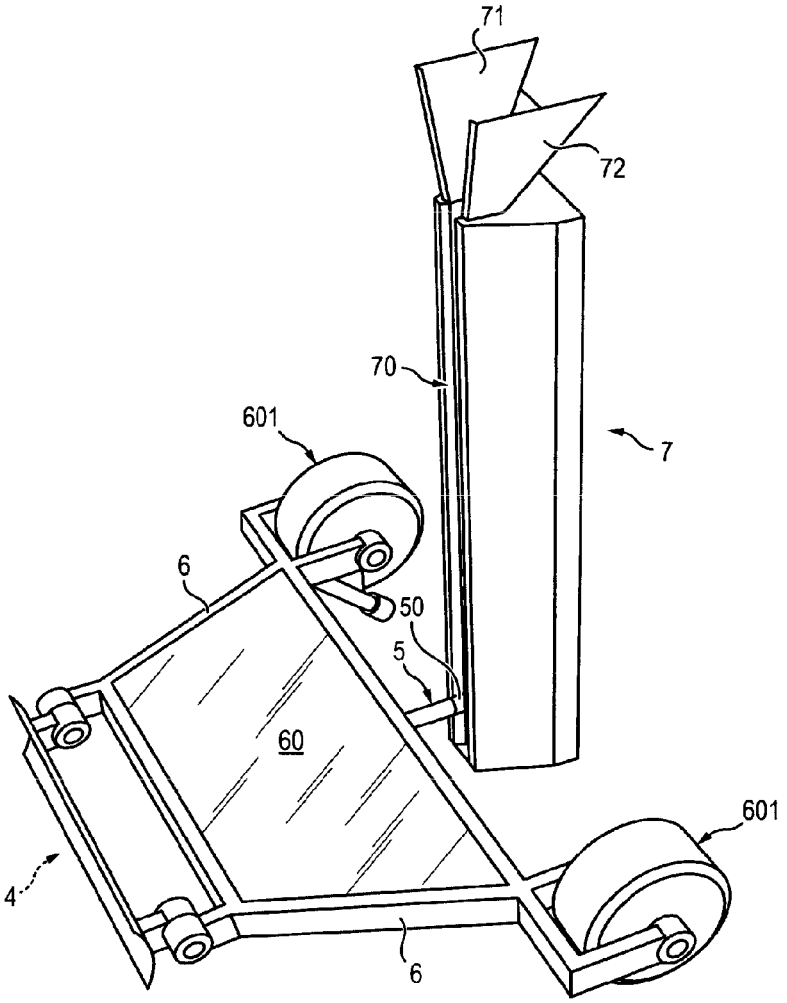
FIG. 3 is a perspective view of the aforementioned guidance and of the means with which it cooperates.

As is particularly visible in FIG. 3, the end 50 with the shape of a sphere is configured to be engaged in the profile 7 and to move in the vertical direction along the guidance path. More precisely, the profile 7 has, seen from above, a "C" shape with an opening 70 turned toward the basket 7. Its upper end is open so that the sphere 50 can be engaged in this profile only at the top. For the purpose of facilitating engagement from the top downward, the upper end of the profile 7 can advantageously be designed to be divergent upward and/or forward and includes for this purpose a set of plates 71 and 72 which confers a funnel shape to the assembly.

We will now explain how to use the installation according to the present invention, first of all with reference to FIGS. 1 and 2. In these figures, the craft to be returned to the deck of the ship is already placed in the basket 4. This assumes that, previously, the lifting device 3 has been actuated so as to have it occupy the position illustrated where the plate 33 is in large part vertically above the water. Moreover, the cables 35 have been controlled so that they occupy a low position in which the basket 4 is located at the level of the water, or slightly lower. In doing so, during the descending movement, the sphere 50 of the arm 5 has been engaged in the interior of the profile 7, this maneuver being facilitated by the funnel shape of its upper portion.

During the descending movement, the sphere 50 travels in the interior of the profile, while the wheels (or rings or skids) 601 bear against the wall 10 of the ship. During this descending movement but also during the contrary rising movement, the possible movements of the basket in translation in the direction of the ship 1 are prevented by the rod 5, likewise the movements of the wheels. On the other hand, possible "pitch" (rotation around the transverse horizontal axis), "roll" (rotation around the longitudinal horizontal axis), and "heave" (translation on the vertical axis) movements are not blocked when the basket is in the flotation position.

Once the craft E has been placed on the basket, which is itself in the flotation position, to have it occupy the positions of FIGS. 1 and 2, the winding of the cables is then controlled so as to have the basket rise in the direction of the dolly 34 and plate 33. During this rising movement, the aforementioned movements are also blocked, which greatly improves the safety of person who are either located in the craft, or located in proximity to the installation. The rising movement is continued until the cables 35 occupy their high position, in which they are wound in the interior of the dolly 34.

In doing so, the upper surface 430 of the basket 4 comes into direct contact, or into engagement, with the lower surface 341 of the dolly 34, so that the basket 4 is to some degree immobilized with respect to the lifting device 2. As mentioned above, the upper surface 430 of the basket 4 is discontinuous here, i.e. consisting of two portions facing one another. They therefore bear at the same time against the lower surface 341 of the dolly. But this could also consist of a single upper surface 430 and a lower surface 341 in two portions, or surfaces 430 and 341 in several portion, the essential matter being that they bear directly against one another.

Figure 4:
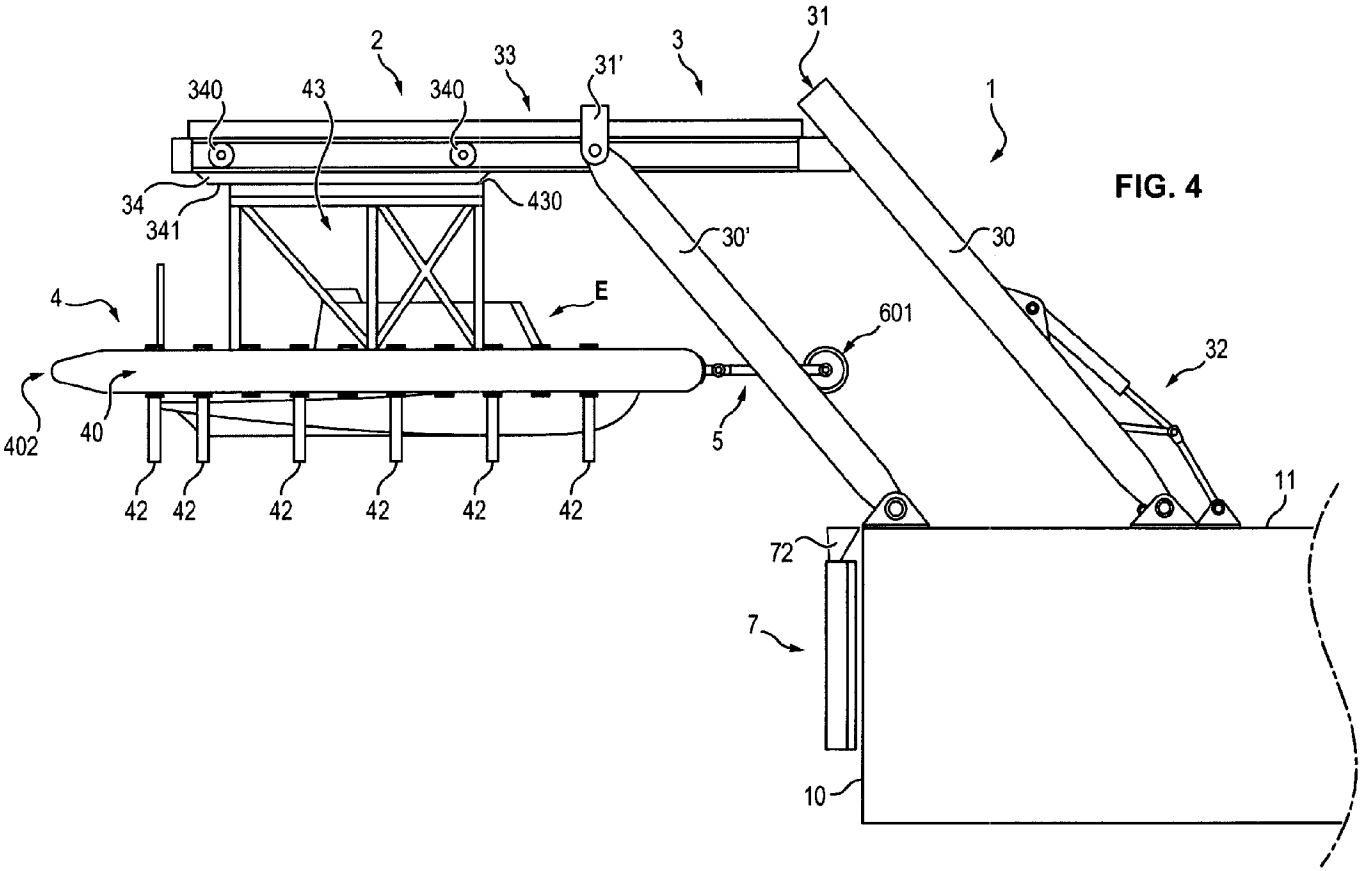
FIG. 4 is a view similar to FIG. 2, but showing a position of the installation in which the cables are in the high position, which corresponds to a transition position for the transfer of a craft to the ship.

During this rising movement, the sphere 50 of the guidance rod 5 is disengaged from the profile 7, as shown by FIG. 4. This naturally arises from the fact that the profile has a height that is much smaller than that which separates the dolly 4 from the water level. In the high position of the basket 4, the possible seesaw movements of the latter are eliminated because it becomes "integral" with the lifting device 2. It is then sufficient to control the dolly 34 as well as the legs 30 and 30' of the device to have it occupy the extreme position of FIG. 5 in which the craft E can be deposited on the deck 11 of the ship.

The embodiment illustrated in FIGS. 6 to 10 has great similarity with the preceding one. For this reason, the numerical labels of the elements common to the two embodiments are identical. With some exceptions, only the differences relating to this second embodiment will be described hereafter. The first essential difference resides in the fact that the guidance member 5' has a different shape from that described previously.

Unlike the pair of arms 6 constituting the frame 60, what is involved is a cross-member 5', cylindrical here, of which the two opposite ends carry wheels 50' or other rolling or sliding members of the skid, inflatable ring, etc. type. Moreover, instead of the single profile 7, what is involved is a pair of profiles with a "C" shaped cross-section, their respective openings, directed vertically, facing one another. The two profiles 7 have the function of guiding, as before, the wheels 50' during the rise/descent of the basket 4. The profiles 7 are advantageously designed to be fixed. However, they could be made sliding with respect to the wall 10, so as to be able to retract their upper end downward, which during the operation of the device is raised above the plane of the deck 11.

Also shown in the figures is additional stabilizing equipment which can, if applicable, be associated with the profiles 7. This equipment is integral with the dolly 34. Here it comprises arms 8, in this case two pairs of arms 8, which extend obliquely and downward from the dolly 34.

The lower end of each of these pairs is extended by a profile 80 which has the same shape and the same interior dimensions as the profiles 7. The assembly is configured so that in a rising/descending position of the basket 4 (FIGS. 6 to 9), the profiles 80 bear against the apex of the profiles 7 of which they constitute the extension in a manner of speaking. Under these conditions, during the movement of the basket 4 into the high position, the wheels 50' leave the profiles 7 to enter into the profiles 80. Moreover, in that these profiles 80 are integral with the dolly 34, the wheels 50' remain prisoners of the profiles 80, even during the extreme maneuver (FIG. 10) of transfer of the craft E to the deck 11 of the ship. There too, this operation is accomplished with a perfectly stable craft.

Figure 11:
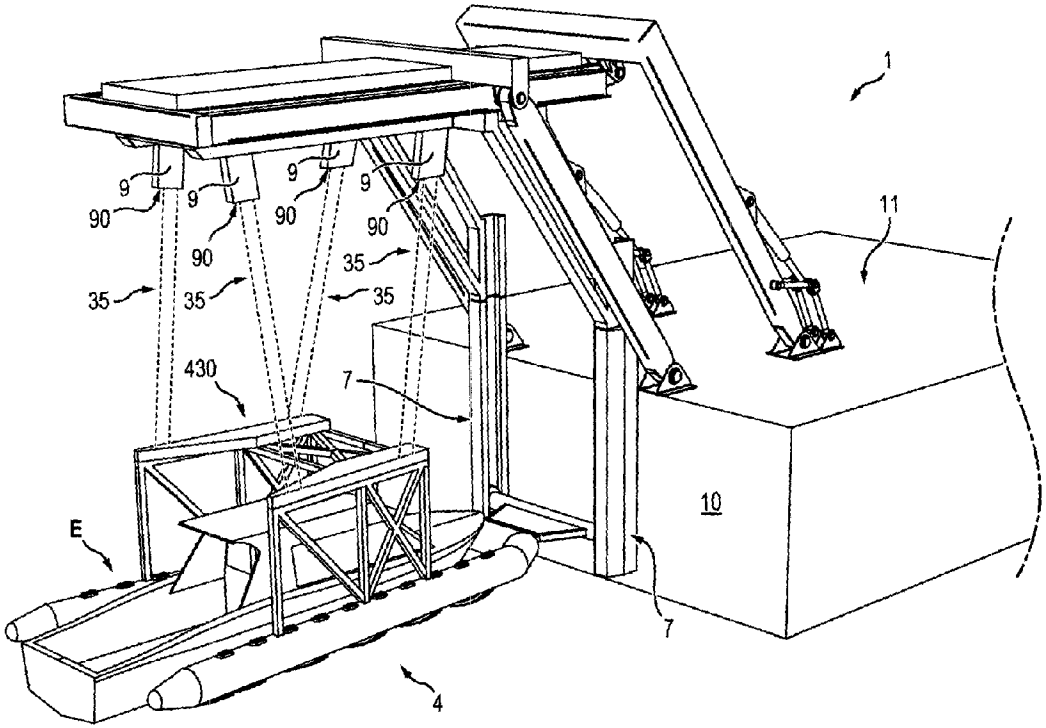
FIG. 11 is a perspective view of another embodiment of the invention.

In the embodiment of FIG. 11, the installation is practically identical to that of FIGS. 6 to 10. However, what is involved here are four cables 35 which retain the basket 4, each cable being associated with a stabilizing device 9, called in professional terms a "brace," which has the function of guiding the cables and holding them separated two by two. When the basket 4 is moved toward its high position, then the aforementioned surface 430 bear against the lower face 90 of each of the braces. In this case, two braces are in contact with a first portion of the surface 430 and the two others with the second portion.

Figure 12:
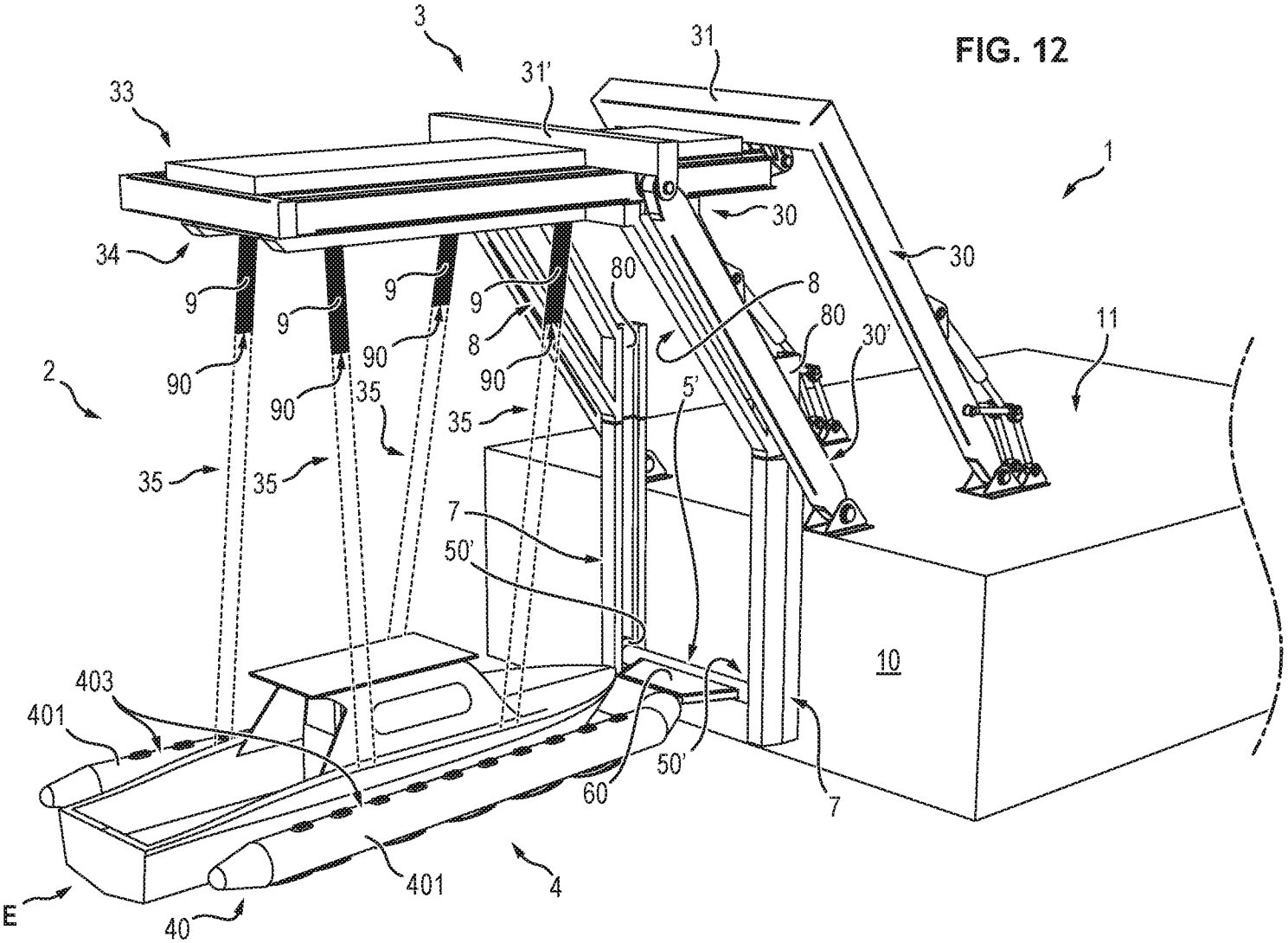
FIG. 12 is also a perspective view of a variant of the embodiment of FIG. 11.

The embodiment which is shown in FIG. 12 is extremely close to the preceding one. In fact, stabilizing devices 9 ("braces") similar to those previously described, but of great length, are also used here. Moreover, the basket 4 which receives the craft E has no cage 43, so that the cables 35 associated with the stabilizing devices 9 are attached to the upper face 403 of the flanks 401 of the float 40 of the basket 4. In this embodiment, the length of the stabilizing devices is substantially identical to the height of the cage 43 described in the other embodiments, to allow the recovering of floating vehicles of substantially identical size. Under these conditions, when the craft E completes its rise, each aforementioned upper face 403 bears against the lower face 90 of two of the braces 9.

It is noted from the preceding description that all the maneuvers of recovering or launching of a floating or non-floating vehicle are in large part made safe by the fact that possible translation or rotation movements are perfectly controlled. Consequently, the maneuvers can be carried out with full safety.

The invention claimed is:

1. A ship provided with an installation for launching and recovering a floating or submersible vehicle, which comprises:

a lifting device including a set of cables which retain a basket configured to support said vehicle during said launching and recovering operations, said cables being movable vertically between two extreme positions, respectively high and low, wherein said basket includes at least one upper face which bears against at least one surface, referred to as a "contact surface", of said lifting device, only when said cables are in said high position, and a guide connecting said basket to a wall of said ship, which is configured to block possible translation movements of "sway" or "surge", and rotation movements of "yaw" of said basket, when said basket is in a flotation position, said guide comprising spaced apart wheels, rings or skids;

wherein said guide cooperates with at least one profile with a guidance path with a generally vertical direction mounted on said wall of said ship, said member including at least one end which is configured to be engaged in said at least one profile and to move in a vertical direction along said guidance path during said launching and recovering operations; and wherein said end of said guide has a shape of a sphere.

2. The ship according to claim 1, wherein said lifting device includes a dolly on which is arranged said set of cables, said dolly being configured to be moved horizontally.

3. The ship according to claim 2, wherein said "contact surface" of said lifting device includes at least one portion of a lower face of said dolly.

4. The ship according to claim 2, wherein said "contact surface" of said lifting device includes a lower face which protrudes downward from said dolly.

5. The ship according to claim 1, wherein said basket is provided with at least one float.

6. The ship according to claim 5, wherein said "contact surface" of said lifting device includes a lower face of said cables which protrude downward from a dolly of said lifting device, and a float includes at least one upper face which bears against said lower face only when said cables are in said high position.

7. The ship according to claim 1, wherein said guide comprises a rod extending in a substantially horizontal direction between said basket and a wall of said ship.

8. The ship according to claim 1, wherein said guide is coupled to two elements which are in contact with said wall of said ship, on either side of said guide, thus forming a linear rectilinear connection with said wall of said ship.

9. The ship according to claim 1, wherein said guide cooperates with a pair of profiles with a guidance path with a generally vertical direction, mounted on said wall of said ship, said guide is configured to be engaged in a profile and to move in said vertical direction along said guidance path during said launching and recovering operations.

10. The ship according to claim 1, wherein said lifting device includes a dolly on which is arranged a set of cables, said dolly being configured to be moved horizontally, and said dolly carries a pair of profiles which are configured to be selectively positioned above and in extension of said profiles mounted on said wall.

11. A ship provided with an installation for launching and recovering a floating or submersible vehicle, which comprises:

a ship deck and a ship hull;

a basket configured to support said vehicle during said launching and recovering;

a lift coupled to said deck, said lift including cables coupled to said basket, said cables being movable vertically between two high and low positions;

floats coupled to at least outboard sides of said basket with a vehicle-opening area located between the floats and above said basket;

a guide projecting from a forward portion of said basket, said guide comprising wheels, rings or skids;

at least one profile mounted to said hull and connecting said guide to said hull when said basket is in a floating position; and said guide and said profile being configured to deter translation movements and rotation movements of said basket;

wherein said lift comprises multiple sets of legs with lower ends pivotally hinged to said deck, and upper ends of at least one of said sets of legs being movable from an outboard position outboard of said hull to an inboard position above said deck.

12. The ship according to claim 11, wherein an end of said guide has a shape of a sphere.

13. The ship according to claim 11, wherein said lift includes a horizontally moveable dolly to which is coupled said cables, said dolly being cantilevered over the vessel and outboard of said hull when said cables are in said low position, and said dolly and basket being movable to an inboard position above said deck when said cables are in said high position.

14. The ship according to claim 11, wherein said profile includes multiple parallel and vertically elongated profiles.

15. A ship provided with an installation for launching and recovering a floating or submersible vehicle, which comprises:

a ship deck and a ship hull;

a basket configured to support said vehicle during said launching and recovering;

a lift coupled to said deck, said lift including cables coupled to said basket, said cables being movable vertically between two high and low positions;

floats coupled to at least outboard sides of said basket with a vehicle-opening area located between the floats and above said basket;

a guide projecting from a forward portion of said basket;

at least one profile mounted to said hull and connecting said guide to said hull when said basket is in a floating position;

said guide and said profile being configured to deter translation movements and rotation movements of said basket;

said profile including a vertically elongated and substantially C-shaped opening, and said profile being stationarily secured to an outer wall of said hull;

said guide including spaced apart wheels, rings or skids; and a portion of said guide engaging with said opening of said profile when said basket is in said floating position but said portion of said guide disengaging from said opening of said profile when said basket is inboard above said deck.

16. The ship according to claim 15, wherein said lift comprises multiple sets of legs with lower ends pivotally hinged to said deck, and upper ends of at least one of said sets of legs being movable from an outboard position outboard of said hull to an inboard position above said deck.

17. A ship apparatus comprising:

a support configured to launch and recover a floating or submersible vehicle;

a lift comprising vertically moveable cables coupled to said support, said lift further comprising upstanding legs with hinged lower ends and a dolly horizontally movable relative to raised upper ends of said legs, and said cables being movable with said dolly;

floats coupled to at least outboard sides of said support with a vehicle-receiving opening located between the floats;

a guide projecting from said support, said guide comprising wheels, rings or skids;

at least one vertically elongated and stationary profile, said guide being movably connected to said profile in at least one operating condition but being disconnected in another operating condition; and said guide and said profile being configured to deter translation movements and rotation movements of said support in at least one position of said support.

18. The ship apparatus according to claim 17, further comprising:

a ship deck and a ship hull;

said legs of said lift including said lower ends which are pivotally hinged to said deck, and said upper ends of said legs being movable from an outboard position outboard of said hull to an inboard position above said deck; and said profile being attached to an outside wall of said hull.

19. The ship apparatus according to claim 17, wherein:

said profile includes a vertically elongated and substantially C-shaped opening, and said profile being stationarily secured to a ship hull; and said wheels, rings or skids of said guide being spaced apart, and in contact against said ship hull or said profile when said cables raise said support.

* * * * *